United States Patent [19]

Stahlecker

[11] Patent Number: 4,574,581

[45] Date of Patent: Mar. 11, 1986

[54] FIBER FEED ARRANGEMENT FOR FRICTION SPINNING

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, both of Fed. Rep. of Germany

[21] Appl. No.: 626,930

[22] Filed: Jul. 2, 1984

[30] Foreign Application Priority Data

Jul. 2, 1983 [DE] Fed. Rep. of Germany ..... 3324001

[51] Int. Cl.[4] ..... D01H 7/882; D01H 7/892

[52] U.S. Cl. ..... 57/401; 57/408

[58] Field of Search ..... 57/401, 400, 402, 403, 57/408, 409, 410, 411, 412, 413

[56] References Cited

U.S. PATENT DOCUMENTS 3,986,329 10/1976 Safar ..... 57/413
4,109,454 8/1978 Fehrer et al. ..... 57/412 X
4,435,955 3/1984 Sumner ..... 57/413 X

FOREIGN PATENT DOCUMENTS 3127415 2/1983 Fed. Rep. of Germany ..... 57/400

*Primary Examiner*—Stuart S. Levy
*Assistant Examiner*—Joseph J. Hail, III
*Attorney, Agent, or Firm*—Barnes & Thornburg

[57] ABSTRACT

An arrangement is disclosed for open-end friction spinning with two adjacently arranged friction rollers driven in the same rotational direction and forming a wedge shaped yarn forming gap. An inlet and opening device is provided for feeding single fibers to the wedge gap, and a yarn withdrawal device is provided for drawing off the yarn being produced in the longitudinal direction of the wedge gap. Between the inlet and opening device and the friction rollers a closed fiber feed channel is arranged which includes devices for reducing the flight speed of the fibers so that the optimum high speed operation of the opening device is facilitated while the fiber speed is subsequently reduced to optimize the yarn forming process.

23 Claims, 18 Drawing Figures

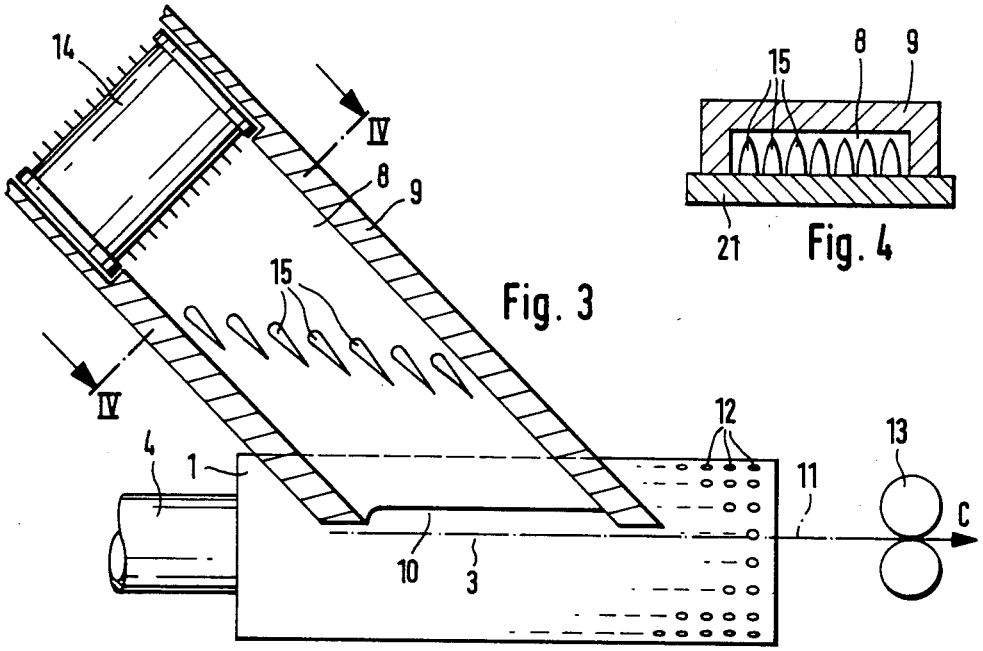
Fig. 3
Fig. 4
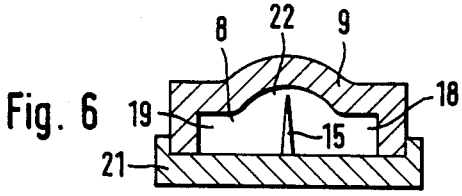
Fig. 6
Fig. 7
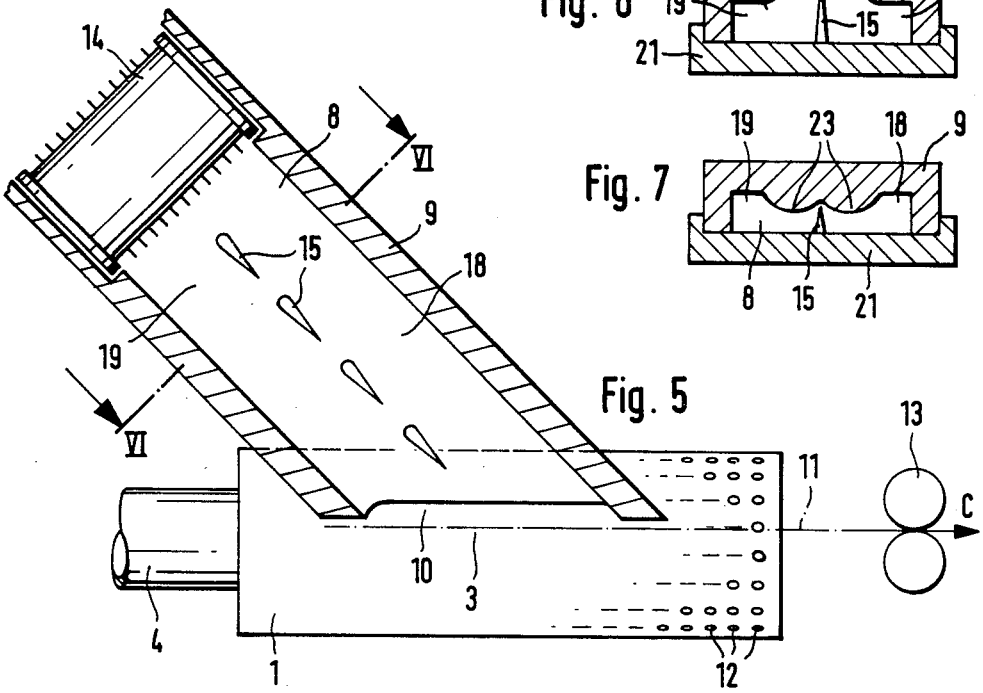
Fig. 5

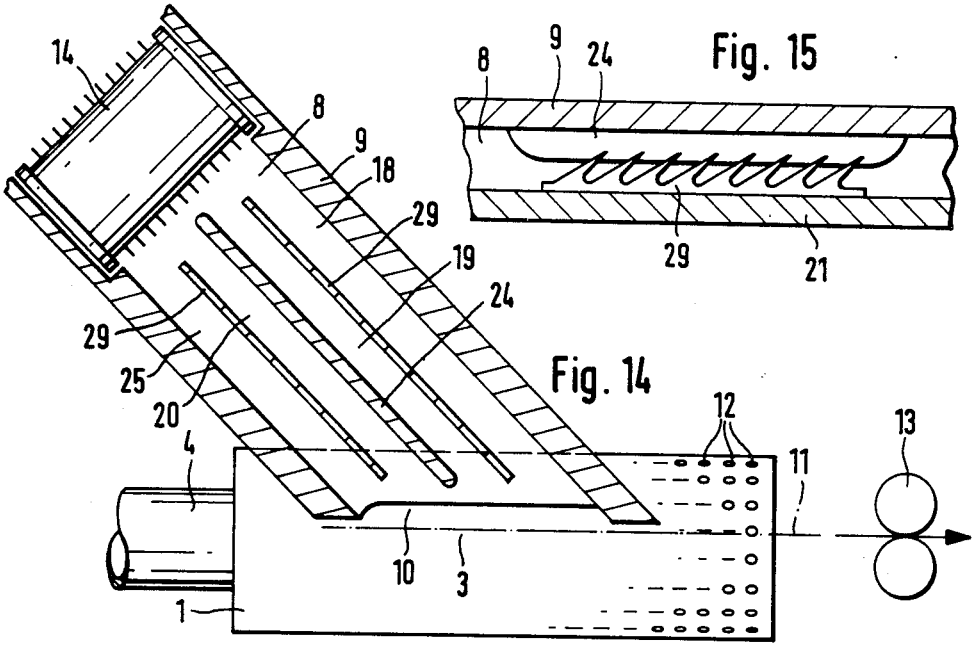
Fig. 14
Fig. 15
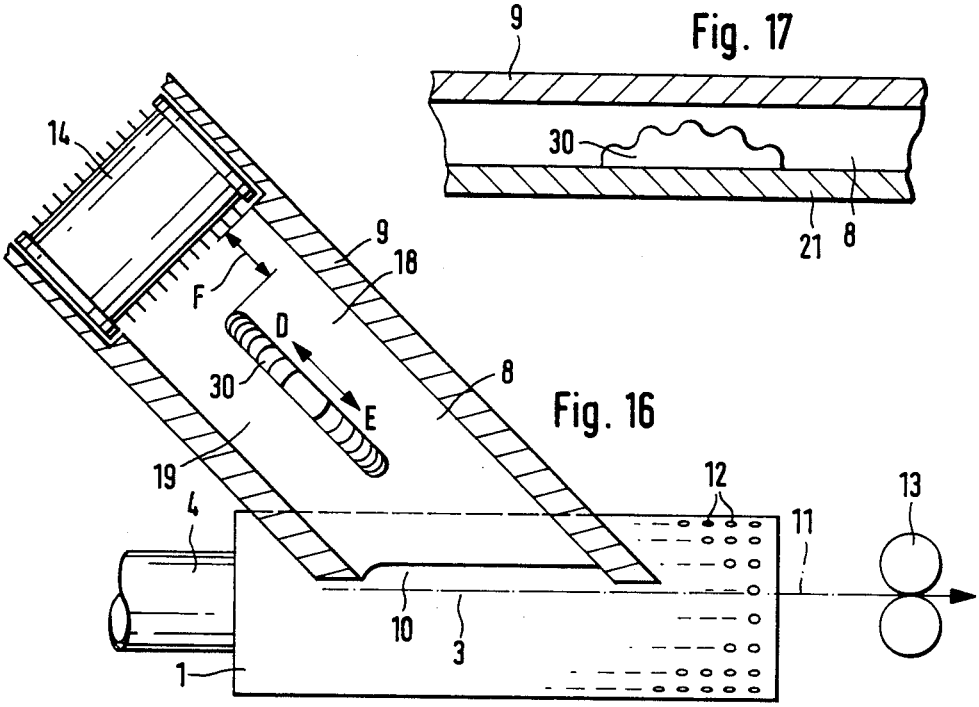
Fig. 16
Fig. 17

FIBER FEED ARRANGEMENT FOR FRICTION SPINNING

BACKGROUND AND SUMMARY OF THE INVENTION

The invention relates to an arrangement for open-end friction spinning with two adjacently arranged friction rollers driven in the same rotational direction and forming a wedge shaped yarn forming gap. An inlet and opening device is provided for opening and feeding single fibers to the wedge shaped gap and a yarn withdrawal device is provided for drawing off the yarn being produced in the longitudinal direction of the wedge shaped gap.

With a known construction of the kind mentioned above (DE-PS) No. 27 20 625, the fibers separated by an opening roller arranged parallel to the axis, are spun off and reach the wedge gap essentially in a free flight. The direction of fiber flight is restricted by guide walls extending in the longitudinal direction of the wedge gap. Since the quality of the yarn to be spun is decisively dependent upon the orientation of the fibers and the deposition of same parallel to each other and preferably extended in the longitudinal direction of the wedge gap, the known construction provides for a centrifugal disk protruding with teeth into the fiber flight space, whereby the teeth move essentially in the direction of the yarn withdrawal. Thereby, the fibers are to receive a motion impulse in the yarn withdrawal direction so that they are largely parallel for spinning purposes. It is, however, questionable whether the desired orientation of the fibers is herewith sufficiently obtained, because this arrangement apparently did not consider that the fibers are supplied with a speed essentially higher than the yarn withdrawal speed of the yarn being produced, so that almost inevitably these fibers are shoved or compressed and take up a tangled position when reaching the area of the wedge gap. The danger of shoving of the fibers is even further increased in that the centrifugal disk means additionally accelerates the fibers. It is furthermore unfavorable that such centrifugal disk requires a drive means which leads to an increase in energy consumption.

It is an object of this invention to design an arrangement of the kind mentioned above to thereby eliminate or decrease the danger of shoving and tangling of fibers when they reach the area of the wedge gap.

This object is acheived according to the invention by providing a closed fiber feed channel between the inlet and opening device and the friction rollers, which fiber feed channel contains means for reducing the flight speed of the fibers.

It was realized with the invention that the speed cannot essentially be reduced with respect to the fibers being spun off the opening roller, because the quality of opening would be impaired if the opening roller were slowed down. The invention thereby involves the concept of reducing the flight speed or transportation speed of the fibers to a range corresponding as closely as feasible to the speed of yarn withdrawal so that the fibers are no longer shoved (tangled) when reaching the area of the wedge gap. Thereby, a much better fiber deposit and simultaneously a better yarn quality is obtained in connection with the guiding of fibers within the closed fiber feed channel. In preferred embodiments of the invention the fiber feed channel is provided with control or guide elements protruding into the flight path of the fibers. These stationarily arranged control elements form an obstacle upon which the fibers hit so that they are mechanically slowed down. They are subsequently accelerated and drawn by means of the transportation air stream controlled within the fiber feed channel.

In order to prevent the fibers from getting caught on the control elements, it is advantageous according to certain embodiments to provide the control elements with a smooth, low friction surface. To serve the same purpose, it is provided in certain further embodiments that the control elements are attached to a channel wall and end at a spacing from the opposite channel wall. It is further provided in preferred embodiments that the control elements are bent in the flight direction of the fibers. It is thereby obtained that also fibers, in the event they wind around the control element, are carried away by the transportation air stream and do not get stuck. In order to additionally straighten the fibers, further embodiments provide that the control elements divide the fiber feed channel in the longitudinal direction into several lanes. In this manner, the transportation air stream occurring within the fiber feed channel can be corrected and controlled.

In still another embodiment of the invention, it is provided that a channel wall is designed as a detachable cover to which the control elements are attached to. This simple means makes it possible to check on the control elements. Additionally, it is also possible to choose the guide elements or control elements that are most suitable in form and arrangement dependent upon the fiber material to be processed, whereby only the cover with the corresponding control elements has to be exchanged.

Further objects, features, and advantages of the present invention will become more apparent from the following description when taken with the accompanying drawings which show, for purposes of illustration only, several embodiments in accordance with the present invention.

BRIEF DESCRIPTION OF THE DRAWINGS

FIG. 3 is a partial sectional view similar to FIG. 2 showing another embodiment of the present invention;

FIG. 4 is a cross-sectional view through the fiber feed channel along the line IV—IV of FIG. 3;

FIG. 5 is a partial view similar to FIG. 3 through another embodiment of the invention, with successively arranged needles in a row;

FIG. 6 is a sectional view taken along the line VI—VI of the fiber feed channel of FIG. 5;

FIG. 7 is a sectional view through a fiber feed channel similar to the one shown in FIGS. 5 and 6, but of a different embodiment form;

FIG. 14 is a sectional view similar to FIG. 3 through an embodiment of the invention with control or guide surfaces which are toothed or serrated at the edges and with a centered partitioning wall;

FIG. 15 is a longitudinal sectional view through the fiber feed channel of FIG. 14;

FIG. 16 is a sectional view similar to FIG. 2 through an embodiment of the invention having a fin-like control or guide surface within the fiber feed channel.

FIG. 17 is a longitudinal sectional view through the fiber feed channel of FIG. 16.

DETAILED DESCRIPTION OF THE DRAWINGS

Figure 1:
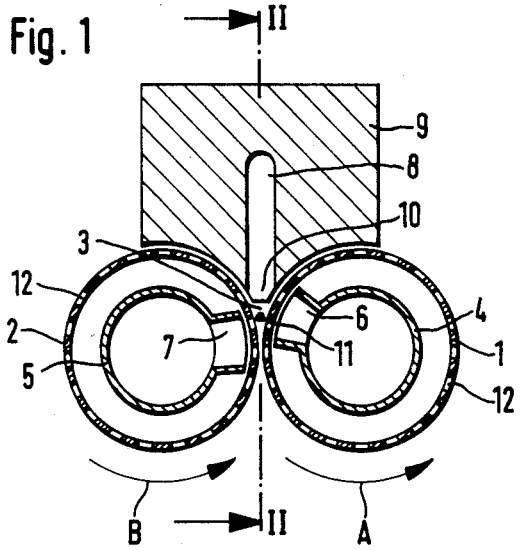
FIG. 1 is a partial schematic cross-sectional view through a portion of an arrangement for open-end friction spinning constructed in accordance with a preferred embodiment of the present invention.
Figure 2:
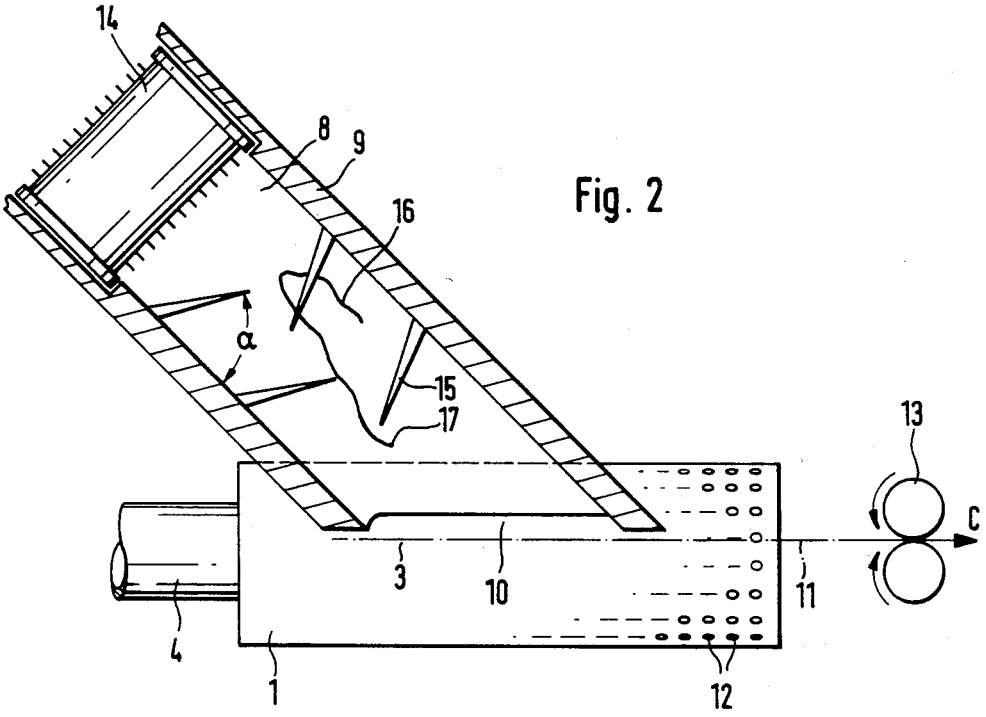
FIG. 2 is a partial sectional schematic view taken along the line II—II of FIG. 1.

The arrangement for open-end friction spinning only schematically depicted in FIGS. 1 and 2 includes two closely adjacently and parallely arranged friction rollers 1 and 2 driven in the same rotational direction depicted by arrows A and B. The two rollers 1 and 2 form together a wedge gap 3, the narrowing area of said wedge gap being utilized as a yarn formation region. The two rollers 1 and 2 are designed as so-called "suction" rollers. Each of rollers 1 and 2 includes a suction insert 4, 5 in its inner space, which insert is connected to a sub-pressure source and is open with suction slots 6 and 7 to the area of the wedge gap 3. The coatings or cover surfaces of rollers 1 and 2 are provided with perforations 12 so that in the area of wedge gap 3, an air stream is sucked in by means of the suction inserts 4 and 5. The rollers 1 and 2 are driven and carried in a manner not further described here so as not to obscure the present invention. As an example, rollers 1 and 2 are borne directly with roller bearings upon suction inserts 4 and 5 and driven by means of a common tangential belt. It will be understood by those skilled in the art that the friction rollers 1 and 2 are part of a spinning unit and that a plurality of commonly driven spinning units can be disposed adjacent one another to constitute a friction spinning machine.

The fiber material opened to single fibers is fed via a fiber feed channel 8 to the area of wedge gap 3. Fiber feed channel 8 is located in a housing part 9 and is disposed opposite the wedge gap 3 with its mouth or opening 10 which extends in the longitudinal direction of the wedge gap 3. The groove-like fiber feed channel 8 is essentially located in the plane of wedge gap 3 (plane parallel to the axes of rollers 1 and 2) and extends in the longitudinal direction of this wedge gap, which means it is inclined in the drawing off direction C of the yarn 11 being produced. The fiber feed channel 8 connects an inlet and opening device of which only the opening roller 14 is shown with the area of wedge gap 3. The inlet and opening device includes an inlet roller described in no further detail (compare also FIG. 18) and a feed table, which offers a single or several adjacently arranged fiber bands in the form of a fiber beard to the opening roller 14 which combs out the fiber band to single fibers. The single fibers are then transported to the area of wedge gap 3 by means of a transportation air stream produced within the channel 8 via the sub-pressure of suction inserts 4 and 5.

In wedge gap 3, the supplied fibers are spun to a yarn 11 which is drawn off in the longitudinal direction C of wedge gap 3 by means of a draw-off roller pair 13 and subsequently is wound upon a spool by means of a winding device not further described herein.

In order to obtain a very high opening efficiency of the fiber band to single fibers, the opening roller 14 is driven with a relatively high rotational speed so that its circumferential surface having a mounting of needles or teeth, displays a relatively high circumferential speed. Thereby, the single fibers are also spun off from the opening roller 14 with a correspondingly high speed. This speed is essentially higher than the appropriate withdrawal speed for yarn 11 being produced. In order to prevent the fibers from impinging on the yarn 11 being produced with this high speed, the fiber feed channel 8 is provided with means by which the speed of the single fibers is reduced. The speed is thereby reduced so far that it at least comes close to the withdrawal speed of yarn 11 being produced. The danger of shoving or buckling of fibers upon arriving in the region of wedge slot 3 is essentially decreased, and thereby also the possibility of the yarn getting tangled.

With the embodiment according to FIG. 2, the means of reducing the flight speed of the fibers is in the form of needles 15 which protrude respectively from the opposite channel wall of fiber feed channel 8 into about its center and are inclined with an angle in the transportation direction or flight direction of the fibers. The needles 15 are of an acute, conical shape. They are chosen with respect to their material and/or produced with regard to their surface, so that little friction occurs between said needles and the fibers.

The effect of the control or guide elements arranged as needles 15 is described, for example, taking FIG. 2 in which a single fiber 16 is shown, the tip of which is indicated with reference numeral 17. It is assumed that the fiber 16 spun off the opening roller 14 reaches a needle 15 and twists itself in the shape of a hairpin. The transportation air stream produced by suction inserts 4 and 5 of rollers 1 and 2 occurring in the fiber feed channel 8, draws fiber 16 off needle 15 whereby the greater force is effective first at the front end 17, so that fiber 16 is drawn off by needle 15 and thereby straightened out. Fiber 16, which is first very much slowed down is then accelerated again, however, it will reach only a relatively slow speed for the remainder of the fiber feed channel 8. This speed is so chosen that it corresponds approximately to the yarn withdrawal speed for yarn 11 being produced. The correct dosage is determined by means of the factors of the length of the fiber feed channel 8 and/or distance of needles 15 to the wedge gap 3, and/or by the force of the applied sub-pressure and thereby the transportation air stream. The end speed of fibers is also influenced by the number of needles 15, that is by its density within the fiber feed channel 8.

In the embodiments of FIGS. 3 to 18, corresponding reference numbers with the suffix "A", "B", . . . are used to designate corresponding but modified structures as bearing the same reference numbers in the other embodiments. Thus, the descriptions of the various structures in the various embodiments can be used in conjunction with the other embodiments.

With the embodiment according to FIGS. 3 and 4, the needles 15A are ajacently arranged in a row which extends about parallel to wedge gap 3. Again, the needles 15A are inclined in the transportation direction of the fibers and thereby are set in a zig-zag line in the transportation direction so that each fiber spun off by the opening roller 14 will meet with a great certainty upon one of needles 15A, without it being necessarily that the channel cross-section available for the air stream is being closed.

Needles 15A are each attached at one end to cover 21 which is detachable arranged at the housing part 9A. The needles reach with their tips almost touching the opposite channel wall. However, the needle tips still are spaced from the opposite channel wall at a distance several times as wide as the fiber thickness. By exchanging the covers 21A with a cover having a other arrangement and/or form and/or density of needles 15A, it is possible to adjust the arrangement to another fiber material respectively while still obtaining optimal operational conditions. In a modification of this embodiment, it is further provided that the needles 15A are additionally inclined in the flight direction of the fibers in such a manner, that they extend with their tips almost tangentially to the channel wall of housing part 9A opposite of the cover 21A. It is certainly also possible according to yet further contemplated embodiments to sequentially arrange more than one such row of needles 15A. Also, with this embodiment, the fiber speed in the area of the mouth or orifice 10 is influenced by the factors of the arrangement of said needles and/or the amount of needles 15A, their distance from the mouth or orifice 10 and/or the predetermined suction forces applied.

With the embodiment according to FIGS. 5 and 6, the fiber feed channel 8B is provided with needles 15B which are sequentially disposed in a row in the flight direction of the fibers so that the fiber feed channel 8B is divided into two lanes 18 and 19 by needles 15B. The needles 15B here are detachable arranged at the cover 21B attached to structural part element 9B. As can be seen from FIG. 6, the housing part 9B in its center area and thereby in the area of needles 15B includes a widening 22 so that in this area the corss-section is enlarged. Thereby a transformation of the transportation air stream to the center area of the needles is retained.

In modification of the embodiment according to FIGS. 5 and 6, it is provided with the embodiment according to FIG. 7 that the needles 15C attached to the detachable cover 21C are designed relatively short and that the cross-section of the channel in the area of the needles 15C is reduced by means of two convex ribs 23. Which of the two modifications leads in practice to more favorable results is determined by very simple tests whereby the staple length of the fiber material to be processed plays an essential role.

Figure 8:
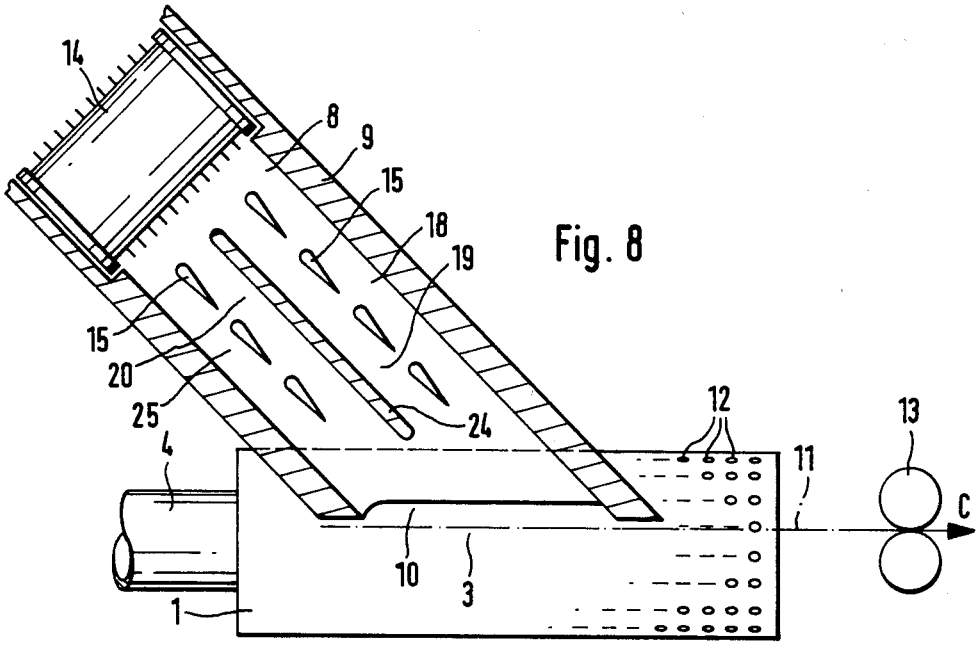
FIG. 8 is a sectional view similar to FIG. 2; showing another embodiment of the invention with two rows of needles extending in the fiber flight direction and a centered guide wall.
Figure 9:
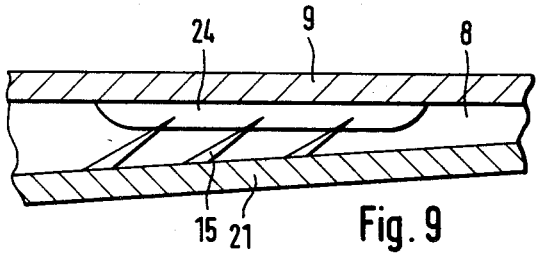
FIG. 9 is a partial sectional view through the fiber feed channel of FIG. 8 in its longitudinal direction.

With the embodiment according to FIGS. 8 and 9, two rows of needles 15D are provided which are arranged sequentially and in transportation direction of the fibers whereby an additional dividing occurs by means of a partitioning wall 24. Thereby the fiber feed channel 8 is altogether divided into four lanes 18D, 19D, 20 and 25. Needles 15D bent in the transportation direction are attached to a detachable cover 21D (FIG. 9). The channel wall formed by the housing part 9D is provided with the partitioning wall 24 which is designed as a rib and remains at a distance to the channel wall formed by the cover 21D. The two ends of the partitioning wall 24, especially the end facing the opening roller 14, are rounded in order to avoid the fibers getting caught.

Figure 10:
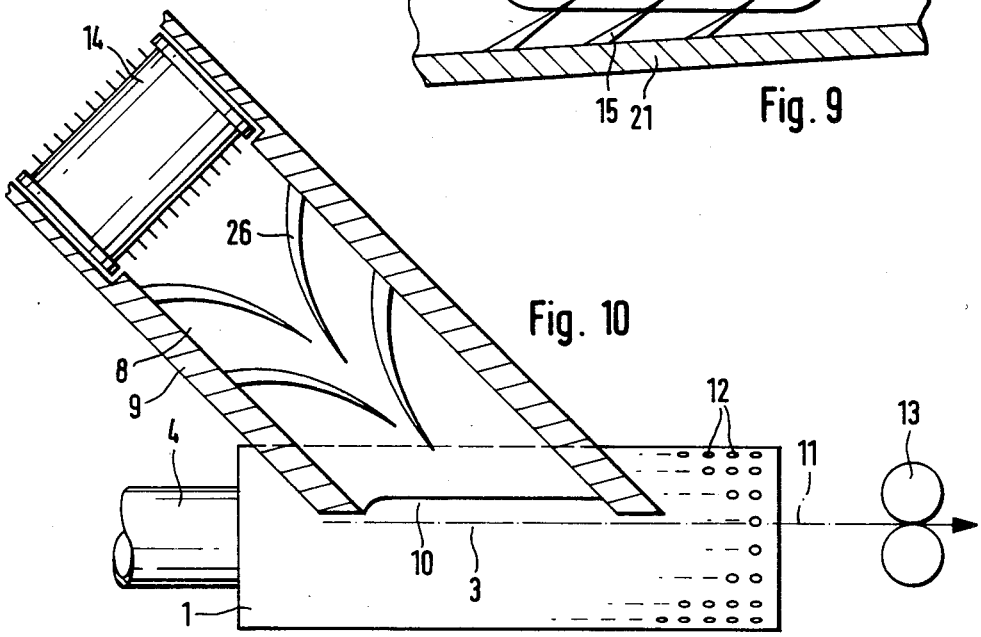
FIG. 10 is a sectional view similar to FIG. 2 through another embodiment of the invention having needles bent in the flight direction of the fibers.

With the embodiment according to FIG. 10, in contrast to the embodiment according to FIGS. 3, 4 and 5, and 6, but corresponding to the embodiment according to FIG. 2, needles 26 protrude from the sides of the flat, groove-shaped fiber feed channel 8E. The needles 26 here are inclined in the transportation direction of the fibers, that is to say in the longitudinal direction of the fiber feed channel 8, and are curved additionally in this direction so that their pointed ends extend into the channel center and are pointing in the transportation direction.

Figure 11:
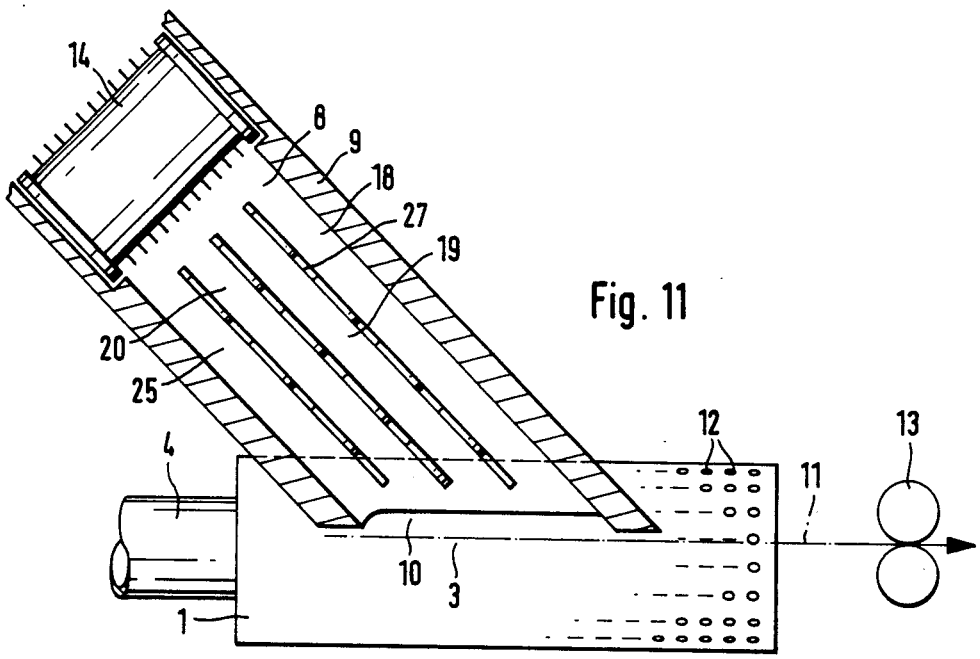
FIG. 11 is a sectional view similar to FIG. 2 through another embodiment of the invention with control or guide surfaces arranged within the fiber feed channel.
Figure 12:
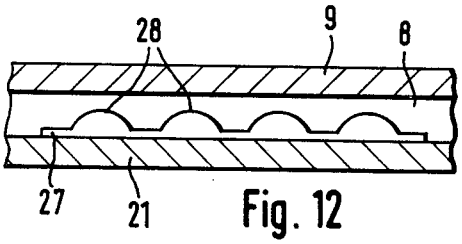
FIG. 12 is a partial sectional view in the longitudinal direction of the fiber feed channel of FIG. 11.

With the embodiment according to FIGS. 11 and 12, the fiber channel 8F is divided into four lanes, 18F, 19F, 20F and 25F, by means of guide surfaces 27 formed as guide plates. Guide surfaces 27 extend parallel to each other and evenly divide the fiber feed channel 8F. The guide plates 27, which include convex or wave-like protrusions 28, extend in the radial plane to opening roller 14. They are all fixedly attached to cover 21F which is arranged detachable at the housing part 9F so that it can be exchanged. The height of the protrusions 28 are dimensioned so that a distance to the opposite channel wall is retained.

Figure 13:
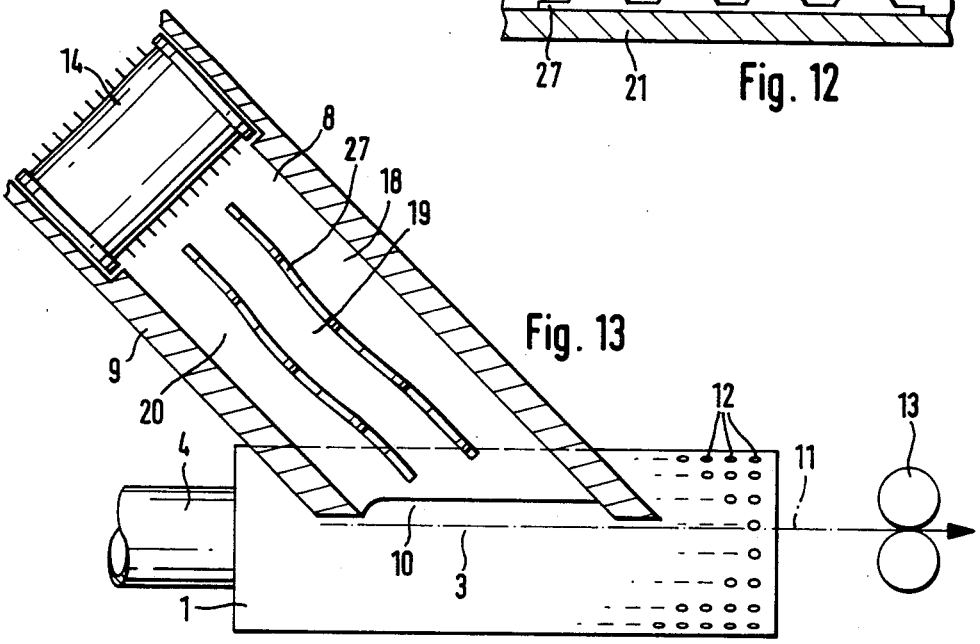
FIG. 13 is a sectional view similar to FIG. 2 through an embodiment of the invention with control or guide surfaces extending slope-like in the longitudinal direction of the channel.

The cover 21F with the guide plates 27 is selectively exchangeable for the adaptation to another fiber material, for example by substituting a cover including guide plates 27G corresponding to FIG. 13 which are wave-like bent in the longitudinal direction of the channel so that the cross-section of lanes 18G, 19G, and 20G are changed in the fiber transportation direction. With the embodiment according to FIG. 13, only two guide surfaces 27G are provided which number or amount can certainly be increased dependent upon the desired effect according to yet other contemplated embodiments.

With the embodiment according to FIGS. 14 and 15, the fiber feed channel is divided in its longitudinal direction into four lanes 18H, 19H, 20H and 25H, by means of two guide surfaces 29 and a centered partitioning wall. The partitioning wall 24H is spaced from the opposite channel wall and is provided with rounded edges, the wall 24H being aranged at the housing part 9H. The guide surfaces 29 are detachable arranged at cover 21H and are designed as rack rails towards which teeth are arranged inclined in the transportation direction of the fibers.

With the embodiments according to FIGS. 16 and 17, the fiber feed channel 8I is divided into two identical lanes 18I and 19I by means of a fin-like guide surface 30. The fin-like guide surface 30 is detachably mounted to a cover 21I attached to the housing part 9I and ends at a spacing from the opposite channel wall. The edge facing this channel wall is wave-like, profiled and extends altogether in a curve. A distance F is thereby retained between the circumference of opening roller 14 and the beginning of the fin-like guide surface 30. A relatively large distance also remains to the orifice 10 of fiber feed channel 8I. The fin-like guide surface 30 is adjustable in the direction of arrows D and E in the longitudinal direction of the fiber feed channel 8I, so that the distance to the opening roller 14 and to the mouth or orifice can be changed in order to influence the fiber speed. Although here only a single fin-like guide surface 30 is provided, it s contemplated to provide for several of such guide surfaces 30 according to othr non-illustrated embodiments in the invention.

Figure 18:
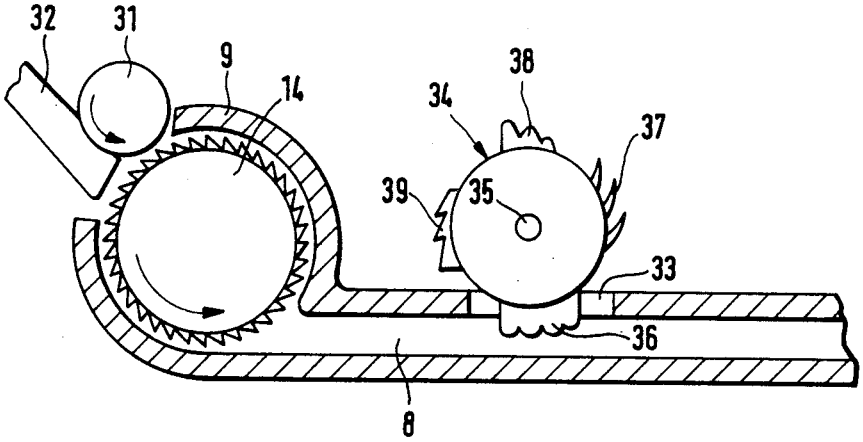
FIG. 18 is a longitudinal sectional view through an inlet and opening device with a connected fiber feed channel and control or guide means which can be selectively inserted into the fiber feed channel by rotating a handle, constructed according to yet another embodiment of the invention.

With the embodiment according to FIG. 18, a fiber feed channel 8J connects the rollers forming a wedge gap that is not shown in further detail with an inlet and opening device which includes an opening roller 14 having a mounting about its circumference, which roller 14 is surrounded by a housing part 9J containing the fiber feed channel 8J. An inlet roller 31 is provided in the transportation direction of the fiber material and in front of the opening roller 14, as well as a feed or inlet table 32 flexibly pressed against the same. The inlet or feed roller 31 offers a single or several adjacently extending fiber bands in the form of a fiber beard to the essentially faster rotating opening roller 14 which combs single fibers out of the fiber bands.

The fiber feed channel 8J is provided with a protrusion 33, at a distance from the opening roller 14 and at a distance to its mouth or orifice, through which fin-like guide surfaces 36 protrude into the fiber feed channel 8J. The fin-like surfaces 36, of which several are adjacently arranged, are component parts of a guide system 34 which is arranged with a manually or mechanically movable handle 35 rotatably mounted at the outside of channel 8J. The guide system 34 is further provided with several different guide elements 36, 37, 38 and 39 on its circumference of which, for example, said guide elements 37 are needles, while the guide elements 38 are fin-like elements and the guide elements 39 are rack rails.

Depending upon the desired spinning conditions and/or the fiber material to be processed, the different guide elements 36, 37, 38 or 39 engage the protrusions 33 into the fiber feed channel by moving the handle 35.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An arrangement for open-end friction spinning of yarn comprising:

drivable friction surface means defining a yarn formation zone, fiber inlet and opening device means for opening up fiber slivers into separate fibers and imparting a flight speed to the separate fibers, fiber feed channel means for guidably feeding the fibers from the fiber inlet and opening device means to the yarn formation zone, yarn withdrawal means for withdrawing formed yarn from the yarn formation zone at a yarn withdrawal speed, and fiber speed reducing means disposed in the fiber feed channel means downstream of the fiber inlet and opening device means and upstream of the yarn formation zone for reducing the flight speed of separate fibers in the fiber feed channel means and for more closely matching the flight speed of the separate fibers to the yarn withdrawal speed.

2. An arranagement according to claim 1, wherein the fiber speed reducing means includes guide elements protruding into the flight path of the fibers in the fiber feed channel means.

3. An arrangement according to claim 2, wherein the guide elements have a smooth, almost frictionless surface.

4. An arrangement according to claim 2, wherein the guide elements are attached at one side to a channel wall and terminate at a spacing from an opposite channel wall of the fiber feed channel means.

5. An arrangement according to claim 2, wherein the guide elements are inclined in the flight direction of the fibers.

6. An arrangement according to claim 2, wherein the guide elements divide the fiber feed channel means in longitudinal direction into several lanes.

7. An arrangement according to claim 6, wherein the lanes extend inclining in the longitudinal direction of the fiber feed channel.

8. An arrangement according to claim 1, wherein the fiber speed reducing means includes guide surfaces arranged within the fiber feed channel means.

9. An arrangement according to claim 8, wherein the free edges of the guide surface are provided with a profiled configuration.

10. An arrangement according to claim 9, wherein the free edge of the guide surfaces are provided with a wave-like profiled configuration.

11. An arrangement according to claim 9, wherein the edge of the guide surfaces are provided with a sawtooth like profiled configuration.

12. An arrangement according to claim 1, wherein the fiber speed reducing means includes needles protruding into the fiber feed channel means.

13. An arrangement according to claim 12, wherein the needles are inclined in the flight direction of the fibers.

14. An arrangement according to claim 12, wherein the needles are curved in the flight direction of the fibers.

15. An arrangement according to claim 12, wherein the needles are arranged in at least one row extending in the longitudinal direction of the fiber feed channel means.

16. An arrangement according to claim 12, wherein the needles are adjacently arranged in a row extending transversely to the longitudinal direction of the fiber feed channel means.

17. An arrangement according to claim 16, wherein the neighboring needles are disposed relative to each other in a zig-zag line in the longitudinal direction of the fiber feed channel means.

18. An arrangement according to claim 1, wherein the guide elements are arranged at respective opposite channel walls of the fiber feed channel means.

19. An arrangement according to claim 1, wherein a channel wall of the fiber feed channel means is arranged as a detachable cover at which guide elements are attached, said guide elements forming the fiber speed reducing means.

20. An arrangement according to claim 1, wherein the fiber speed reducing means includes guide elements arranged at a holder or handle provided outside of the fiber feed channel means and protruding into the fiber feed channel means via an opening of a channel wall of the fiber feed channel means.

21. An arrangement according to claim 20, wherein the handle is rotatably arranged and is provided at its circumference with several guide elements which can be selectively introduced into the fiber feed channel means.

22. An arrangement according to claim 15, wherein a plurality of rows of said needles are provided.

23. An arrangement according to claim 1, wherein the drivable friction surface means comprises a pair of adjacently arranged friction rollers rotatbly drivable in the same direction and the yarn formation zone comprises a wedge-shaped gap formed between the rollers.

* * * * *